United States Patent [19]

Mirvic

[11] Patent Number: 4,896,884

[45] Date of Patent: Jan. 30, 1990

[54] STICK PUZZLE

[76] Inventor: Sal S. Mirvic, 1760 Bush St., Apt. 7/12, San Francisco, Calif. 94109

[21] Appl. No.: 351,543

[22] Filed: May 15, 1989

[51] Int. Cl.[4] ..... A63F 9/08
[52] U.S. Cl. ..... 273/153 J
[58] Field of Search ..... 273/153 J

[56] References Cited

U.S. PATENT DOCUMENTS 486,308 11/1892 Watt ..... 273/153 J
3,359,004 12/1967 Ellis ..... 273/153 J

*Primary Examiner*—Anton O. Oechsle

[57] ABSTRACT

A puzzle involving ten sticks (1–10). A player must carry one stick, e.g. stick 4, over two adjacent sticks, e.g. sticks 3 and 2, and place it across a third stick, e.g., stick 1, to form a "X". The player must repeat this process with other sticks until five sticks are crossed with five moved sticks, thus solving the puzzle.

7 Claims, 2 Drawing Sheets

STICK PUZZLE

BACKGROUND

1. Field of Invention

The present invention relates to a mechanical game puzzle, particularly to such a game or puzzle involving the moving of sticks.

2. Description of Prior Art

In the past, games or puzzles involving the shifting of sticks to solve problems have been relatively easy and have lacked any real challenge to people with a high I.Q. Such puzzles thus were easily solved and quickly became boring.

OBJECTS AND ADVANTAGES

One object of the present invention is therefore to provide a puzzle which is intriguing and a definite challenge to those people who pride themselves with having high I.Q. Another object is to provide a puzzle which is not costly to manufacture or to distribute as a giveaway, e.g., by attaching it to any of numerous more costly products. Still further objects are to provide a puzzle which takes a substantial time to solve and which does not quickly become boring. Yet further objects and advantages will become apparent from a consideration of the ensuing discription and accompanying drawings.

DETAILED DESCRIPTION OF THE PUZZLE AND RULES OF PLAY

Figure 1:
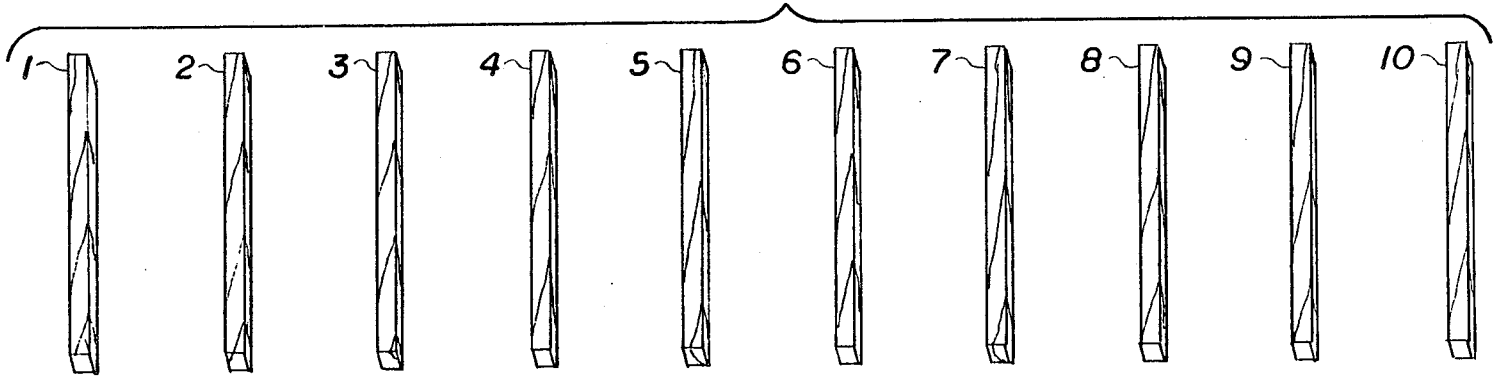
FIG. 1 is a perspective view of a puzzle involving ten sticks arranged according to the invention.

Accordingly to the preferred embodiment of the invention, a puzzle or game involving ten gamepieces or sticks (FIG. 1) identified as sticks 1, 2, 3, 4, 5, 6, 7, 8, 9, and 10. These gamepieces can have any shape or size; however I prefer that sticks be used and these be about 5 cm (2 in) long and have a square cross-section about 3 to 5 mm (⅛ to 3/16) on each side. They preferably are made of wood, but plastic, metal, or even rolled or shaped paper can alternatively be used. To start the puzzle, the sticks are arranged in spaced relationship parallel to each other as shown.

The rules of the puzzle are that the player must solve the puzzle by picking up any stick, carrying it (the first stick) over or across any adjacent pair of sticks (second and third sticks), and then placing it over a fourth stick, preferably by forming an "X". The second stick must be adjacent the first, or in-play stick and the third stick must be adjacent the second stick. The player may not carry the picked-up or in-play stick over more than two sticks.

The player repeates this move until all ten sticks used to form five X's, i.e., five underlaying sticks are crossed by five overlying sticks. The puzzle is then solved.

While the solution of the puzzle may appear easy to accomplish, I have found, that by asking others to play it according to the above rules, that most players, even those with a relatively high I.Q., have great difficulty in solving it successfully.

Players sometimes start playing from one end, i.e. stick 1 or stick 10, and play toward the opposite end, in which case they find they have two playpieces still remaining and which are separated by two pairs of X's, i.e., four sticks. Some players start from both ends and play towards the center only to find they have two remaining playpieces which are separated by four pairs of X's in between. They then try other starting positions which has similar results. What usually happens then is they give up in frustration and/or declare that it must be impossible.

SOLUTION OF PUZZLE

Figure 2:
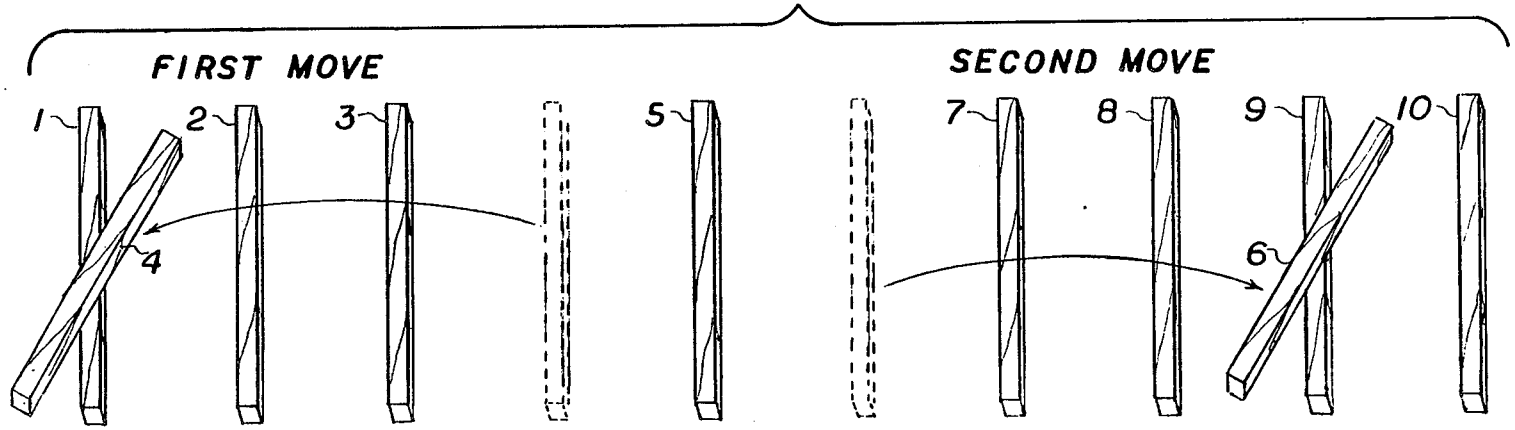
FIG. 2 is a perspective view of of the sticks showing first and second moves used in solving such puzzle.
Figure 3:
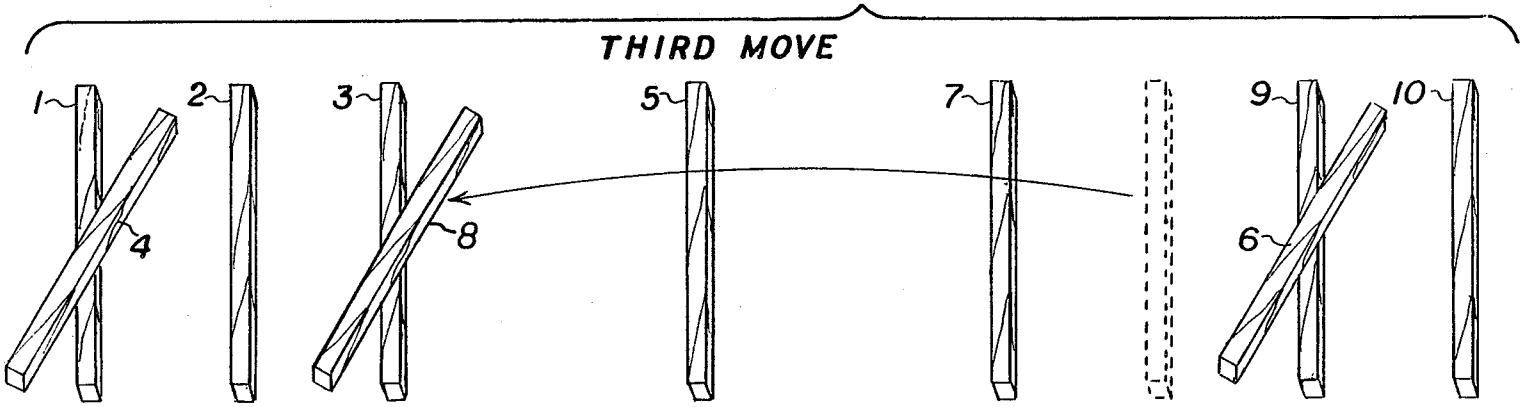
FIG. 3 is a perspective view of of the sticks showing a third move used in solving the puzzle.
Figure 4:
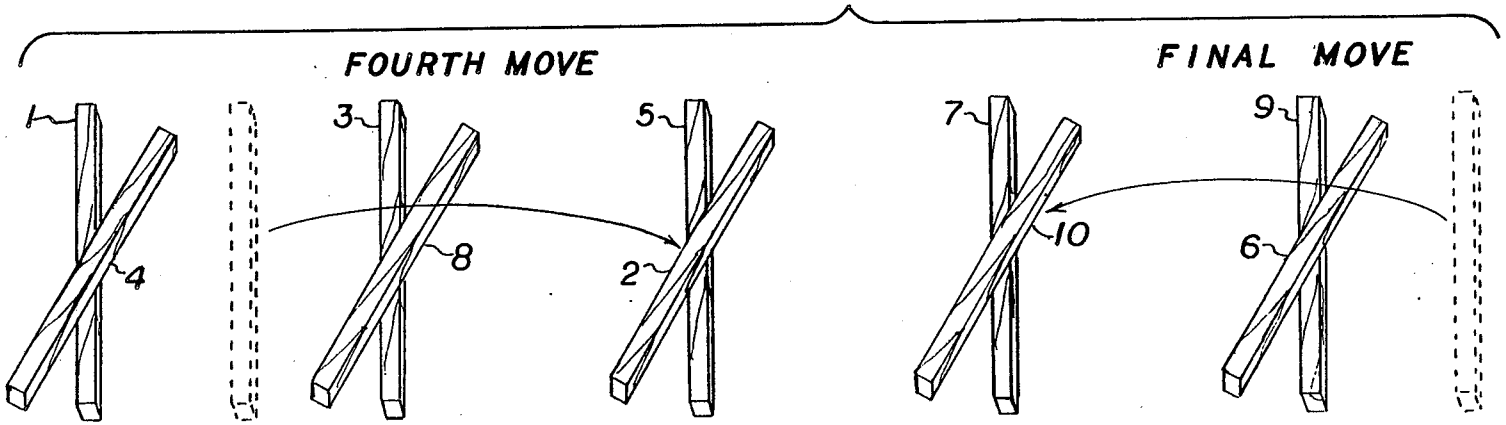
FIG. 4 is a perspective viw of the sticks showing a fourth move and a fifth and final move used to solve the puzzle.

The way to solve the puzzle correctly is clearly shown in FIGS. 2, 3, and 4. FIG. 2 shows that stick 4 (the in-play stick) has been carried across adjacent stick 3 and stick 2, which is adjacent stick 3, and then placed across stick 1 (which is adjacent stick 2) to form an X with sticks 1 and 4. This is the first move.

In the second move (still in FIG. 2) stick 6 has been carried across adjacent and next adjacent sticks 7 and 8 and placed across stick 9 (adjacent stick 8) to form an X with sticks 6 and 9.

In the third move (FIg. 3) stick 8 has been carried across sticks 7 and 5 and laid across stick 3 to form an X of sticks 3 and 8.

In the fourth move (FIG. 4) stick 2 has been carried across sticks 3 and 8 (which are already crossed) and placed across stick 5 to form an X of sticks 2 and 5.

In the fifth and final move, stick 10 has been carried across sticks 9 and 6 (which are already crossed) and placed across stick 7 to form the fifth and final X of sticks 7 and 10.

Each move has involved picking up one stick, carring it across an adjacent and a next-adjacent stick and placing it over a fourth (next-to-next-adjacent) stick to form an X. The moves are repeated until all five sticks are crossed, thus forming five crosses or X's.

Other than the sequence shown in FIGS. 2 to 4 and described above, I have not found any other way to solve this puzzle, although there are many other ways to try. As stated, when most players try to solve the puzzle, they start from one end and play toward the opposite end or they start at the ends and play towards the center, then they start at random somewhere in between and each time find that the final two to four playpieces are separated by more than two sticks and the puzzle cannot be solved according to the rules. Although the puzzle uses relatively simple hardware and has relatively simple rules, it provides a substantial, often frustrating challenge to all who play it.

Preferably the sticks are packaged in a plastic bag, which along with instructions, is placed in an attractive box.

SUMMARY, RAMIFICATIONS, AND SCOPE

Thus the reader will see that I have provided a puzzle which is easy to present, to distribute, and to package. It has no elaborate mechanism, can be carried in one's pocket, and can be placed upon any reasonably flat surface. People from all walks of life, or nationality can attempt to solve this puzzle. Its rules are easy to learn, even by young people. Although there are many ways to try, there is only one way to solve the puzzle. It can be used as a crude I.Q. test.

While the above description contains many specifications, the reader should not construe these limitations on the scope of the invention but merely as exemplifications of preferred embodiments thereof. Those skilled in the art will envision that many other possible variations are within its scope, for example, skilled artisans will readily be able to change the dimentions and shapes of the various embodiments, such as by making sticks 1 to 10 longer, shorter or of different cross sectional shape, e.g., they could be made flat, rectangular, oval, or round, or a combination of two of these shapes. Also the sticks can be made tapered from end to end, or can be curved. They can be made of plastic, or of any other suitable material. In lieu of sticks, the game pieces may be made round, as in the shape of chips, or any other shape such as square, rectangular, oval, hexigonal, etc. In the case of non-elongated pieces, such as chips, instead of forming an X with two sticks, two chips would simply be placed on top of each other to form doubles instead of X's. In lieu of arranging the game pieces in a straight line as shown, they can be arranged in a circle, a curved line, or any geometric figure to start the game. In lieu of ten total game pieces and the requirement of carrying the in-play game pieces over an adjacent pair, other even numbers of the total gamepieces and other numbers of the "carry over plurality" can be used.

Accordingly, the reader is requested to determine the scope of the invention by the appended claims and their legal equivalents, and not by the examples which have been given.

I claim:

1. A method of playing a game, comprising:

providing ten individual, separate, gamepieces, each of said gamepieces comprising an elongated wooden stick having a square cross-section, arranging said ten gamepieces in a straight line, executing a first move by taking a first, in-play gamepiece, carrying it over a pair gamepieces, designated second and third gamepieces, where said second gamepiece is adjacent said first gamepiece and said third gamepiece is adjacent said second gamepiece, and placing said first gamepiece over a fourth, mating gamepiece which is adjacent said third gamepiece, thereby to form an X with said first and fourth gamepieces and also to form a completed pair with said first and said fourth gamepieces, executing subsequent moves in the same manner as said first move with in-play gamepieces, other than gamepieces which have been used to form completed pairs, until all gamepieces have been used to form completed pairs, thereby completing said game successfully, or until additional gamepieces are playable, but cannot be used to form completed pairs, thereby failing to complete said game successfully.

2. A method of playing a game, comprising:

providing an even-numbered group of individual, separate gamepieces, arranging said group of gamepieces in a line, executing a first move by taking a first, in-play gamepiece, carrying it over a plurality of gamepieces, including at least second and third gamepieces, where said second gamepiece is adjacent said said first gamepiece and said third gamepiece is adjacent said second gamepiece, and placing it over a mating gamepiece so as to form an X, said mating gamepiece being adjacent a last, most-distant from said in-play gamepiece, of said plurality of gamepieces, thereby to form a completed pair with said first and said mating gamepieces, executing subsequent moves in the same manner as said first move with in-play gamepieces, other than gamepieces which have been used to form completed pairs, until all gamepieces have been used to form completed pairs, thereby completing said game successfully, or until additional gamepieces are playable, but cannot be used to form completed pairs, thereby failing to complete said game successfully.

3. The method of claim 2 wherein said group of gamepieces are arranged in a straight line.

4. The method of claim 3 wherein said gamepieces are elongated wooden sticks having a square cross-section.

5. A method of playing a game, comprising:

providing ten individual, separate, gamepieces, arranging said ten gamepieces in a line, executing a first move by taking a first, in-play gamepiece, carrying it over a pair gamepieces, designated second and third gamepieces, where said second gamepiece is adjacent said said first gamepiece and said third gamepiece is adjacent said second gamepiece, and placing said first gamepiece over a fourth, mating gamepiece so as to form an X, said fourth, mating gamepiece being adjacent said third gamepiece, thereby to form a completed pair with said first and said fourth gamepieces, executing subsequent moves in the same manner as said first move with in-play gamepieces, other than gamepieces which have been used to form completed pairs, until all gamepieces have been used to form completed pairs, thereby completing said game successfully, or until additional gamepieces are playable, but cannot be used to form completed pairs, thereby failing to complete said game successfully.

6. The method of claim 5 wherein said group of gamepieces are arranged in a straight line.

7. The method of claim 6 wherein said gamepieces are elongated wooden sticks having a square cross-section.

* * * * *